United States Patent [19]

Lautenschläger, Jr. et al.

[11] Patent Number: 4,703,539

[45] Date of Patent: Nov. 3, 1987

[54] CABINET HINGE

[75] Inventors: Karl Lautenschläger, Jr., Reinheim; Gerhard Lautenschläger, Brensbach, both of Fed. Rep. of Germany

[73] Assignee: Karl Lautenschlager GmbH & Co. KG, Reinheim, Fed. Rep. of Germany

[21] Appl. No.: 906,394

[22] Filed: Sep. 12, 1986

[30] Foreign Application Priority Data

Sep. 13, 1985 [DE] Fed. Rep. of Germany ..... 3532650

[51] Int. Cl.[4] ..... E05D 7/04

[52] U.S. Cl. ..... 16/240; 16/246; 16/382

[58] Field of Search ..... 16/238, 240, 245, 246, 16/370, 382

[56] References Cited

U.S. PATENT DOCUMENTS 4,490,883 1/1985 Gauron ..... 16/245

FOREIGN PATENT DOCUMENTS 3223937 12/1983 Fed. Rep. of Germany ..... 16/382

*Primary Examiner*—Nicholas P. Godici
*Assistant Examiner*—Richard K. Seidel

[57] ABSTRACT

Cabinet hinge whose jamb-related part in the form of an arm can be fastened at selectable positions along the length of a mounting plate attached to a jamb on a cabinet carcase by sliding it onto the mounting plate and then tightening a screw. The mounting plate has a spring catch element which as the installation of the arm begins snaps into a corresponding cutout or recess in the arm of the hinge and thus screws it against accidental withdrawal from the mounting plate, without interfering with its further movement for the purpose of a longitudinal adjustment of the arm on the mounting plate. The spring catch has a prolongation brought out of an opening in the cabinet-interior end of the mounting plate, and this prolongation can be shifted resiliently such that the cooperating abutments of the spring catch and opening become disengaged from one another.

7 Claims, 7 Drawing Figures

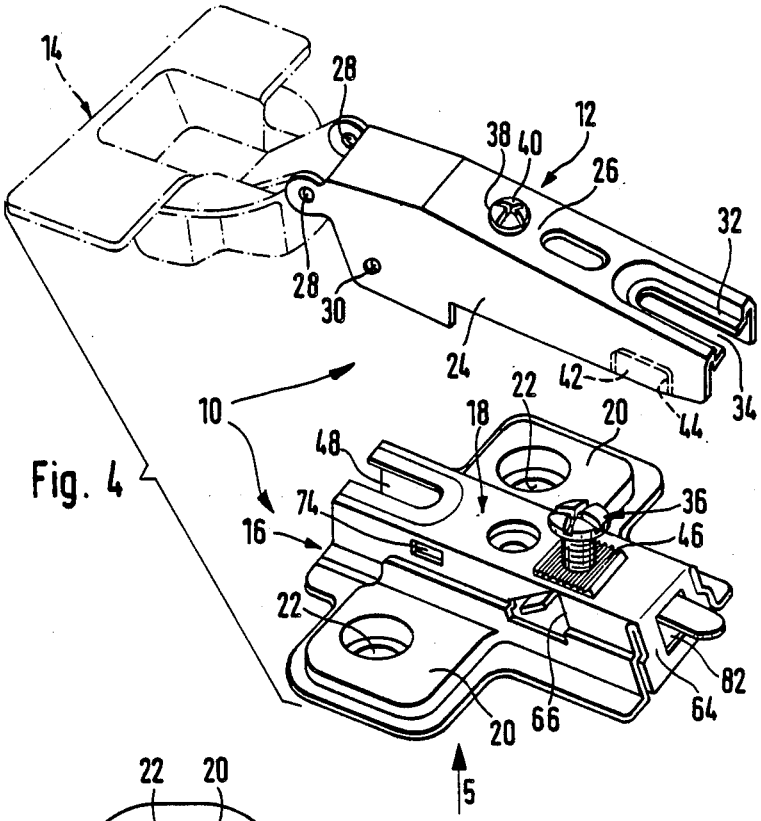
Fig. 4
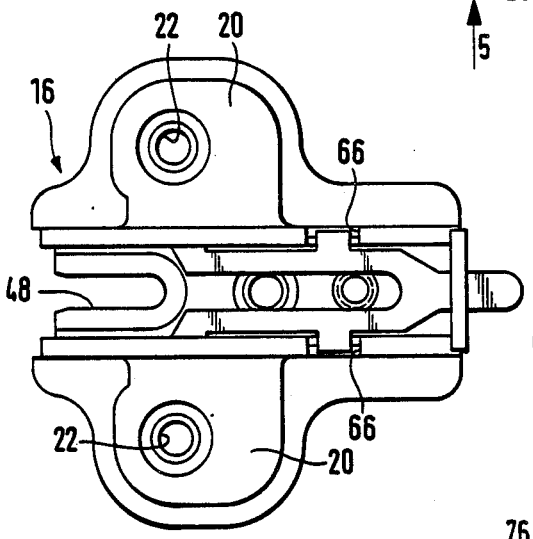
Fig. 5
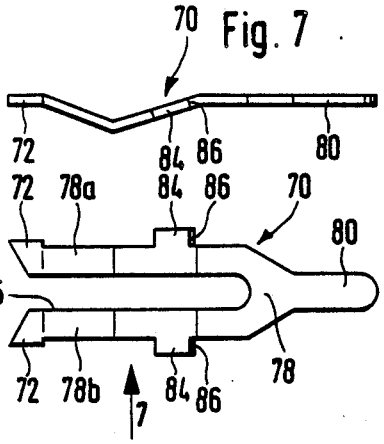
Fig. 7
Fig. 6

CABINET HINGE

BACKGROUND OF THE INVENTION

The invention relates to a cabinet hinge which has a jamb-related part in the form of a channel-like arm which is coupled by a linkage to the door-related part and mounted releasably and for adjustment in at least two coordinate directions on a mounting plate which can be fastened to the jamb. The channel-shaped arm of the hinge at least partially straddles the mounting plate, while its web has a slot that is open-ended or provided with an enlarged opening at its end remote from the hinge joint, through which passes the shaft of a mounting screw threaded into the mounting plate, and it has a tap in the web, through which a screw is threaded which thrusts against the mounting plate. In at least one of the flanges of the channel there is provided a recess or cutout providing an abutment at substantially right angles to the surface of the jamb and facing the hinge-joint end of the arm, and in the area of the mounting plate confronting this recess a resilient catch element protruding from one side of the mounting plate is disposed in such a position that the abutments on the arm and catch element come into catching engagement with one another when the arm is displaced longitudinally on the mounting plate and the shaft of the mounting screw in the mounting plate arrives at the open or enlarged end of the slot in the rearward transitional portion of the latter. With cabinet hinges of this kind (DE-OS No. 32 23 936, DE-OS No. 33 01 279), the disadvantage of older hinges was overcome, which consisted in the danger of the separation of the arm from the mounting plate and thus of dropping a door attached with such hinges to a cabinet when the screws attaching the arm to the mounting plate are loosened for the purpose, for example, of the precise adjustment of the depth or overlay dimension of the door relative to the carcase. By the engagement of the abutments of the catch element and arm when the arm is pushed onto the mounting plate the assurance is provided that unintentional separation will be prevented without making it any more difficult to adjust the arm on the mounting plate or the door on the cabinet jamb than in the case of the hinges of the prior art. The known hinges have proven successful and are widely used. In these hinges, in order to release the safety catch when it is desired to remove a door from the cabinet—when moving furniture, for example—it is necessary only to unscrew the mounting screw holding the arm on the mounting plate, doing so by such an additional amount that the arm can be lifted at right angles to the jamb to such an extent that the abutments on the arm come out of engagement with the abutments on the catch element. In the raised position, the hinge arm can then be removed from the mounting plate. The intentional further backing off of the mounting screws in disassembly does not constitute a great deal of work, but it has the disadvantage that the safety locking of the arm on the mounting plate is not assured when the door is reinstalled on the jamb, if it has been forgotten to first drive the mounting screw back into the mounting plate to the necessary degree.

Accordingly the invention is addressed to the problem of improving the known hinges such that the safety locking of the arm on the mounting plate can be put out of action more quickly and easily for the purpose of disassembly in case of need, and can be restored automatically upon reassembly, while remaining basically just as effective and reliable, without requiring special measures or manipulation.

SUMMARY OF THE INVENTION

Setting out from a cabinet hinge of the kind mentioned above, this problem is solved according to the invention in that the resilient catch element has a prolongation brought out through an opening in the cabinet-interior end of the mounting plate, which can be displaced resiliently in the opening such that the abutments will be disengaged from one another. The safety catch, therefore, can be put out of action if needed, by pressing the prolongation protruding from the mounting plate, without the need to do any more than slightly loosen the mounting screws for this purpose. On account of the resilient properties of the catch element itself, the prolongation will return to the safety position immediately upon its release.

If the catch element is formed of the end section of one leg of a hairpin spring made from spring-steel wire, which is mounted in the hollow interior of the mounting plate such that the free end of this leg brought out through an opening in one side wall of the mounting plate protrudes laterally from the mounting plate at an angle toward the interior of the cabinet, it is desirable to make the configuration such that the bridge joining the two legs of the hairpin spring is mounted pivotingly in the mounting plate about an axis disposed substantially parallel to the base of the mounting plate and at right angles to its length, and that the second leg of the hairpin spring is prolonged and is brought out through the opening in the cabinet-interior end of the mounting plate. This prolonged second leg then forms the handle for the release of the safety catch.

It is then recommendable to configure the opening in the cabinet-interior end of the mounting plate in the form of a slanting slot, so that thus the protruding leg of the spring will be guided in this slanting slot when the safety catch is released. Thus, when the second leg is pressed it will be flexed resiliently transversely in addition to the downward movement, and will accumulate the tension that will return it to the starting position after release.

In the alternative embodiment of the invention, the resilient catch element is a leaf spring whose outer end is held tightly clamped inside of the mounting plate, while its cabinet-interior end forms the prolongation brought out of the cabinet-interior opening in the mounting plate, in which case the leaf spring has, at least at one longitudinal edge, preferably at both edges, tabs passing laterally each through a cutout in the associated side wall of the mounting plate and projecting slightly further into the path of a hinge arm that is to be fastened on the mounting plate, while the portion of the tabs which project from the associated cutout slopes upwardly from its front edge on its hinge-link side. As a consequence of this slope, the tabs are displaced downwardly by the lower longitudinal edges of the flanges of the arm when the arm is slipped onto the mounting plate, until they come into the range of the recess or opening provided in the area of the inner surfaces of the supporting arm and then snap upwardly.

The leaf spring itself can be screwed or riveted at its hinge-joint end to the mounting plate.

To accommodate the screw that fastens the arm to the mounting plate, as well as screws for fastening the mounting plate on the jamb, it is recommendable to divide the leaf spring within the mounting plate into two tongues in parallel spaced relationship by means of a slot extending over a portion of its length, between which the shafts of the screws driven centrally into the mounting plate can pass.

At the same time, the configuration can then be such that the slot is open at the hinge-link end of the leaf spring, and that the tongues of the leaf spring have at their end areas adjacent the hinge joint two tabs each engaged in a mating opening or recess in the side walls. Then, when installing the leaf springs, it is necessary only to squeeze the leaf spring trips slightly together when introducing them into the mounting plate until the tabs are opposite the openings and then to release the spring strips and allow the tabs to enter the openings.

The invention will be further explained in the description that follows of two embodiments, in conjunction with the drawing.

SUMMARY OF THE DRAWING

FIG. 4 is a perspective view represented in the same manner as in FIG. 1, of a second embodiment of the cabinet hinge according to the invention, FIG. 5 is a bottom view of the mounting plate, seen in the direction of the arrow 5 in FIG. 4, FIG. 6 is a top view of the catch element in the form of a leaf spring, which is used in the hinge according to FIGS. 4 and 5, and FIG. 7 is a side view of the same catch element seen in the direction of the arrow 7 in FIG. 6.

DESCRIPTION OF THE PREFERRED EMBODIMENTS

Figure 1:
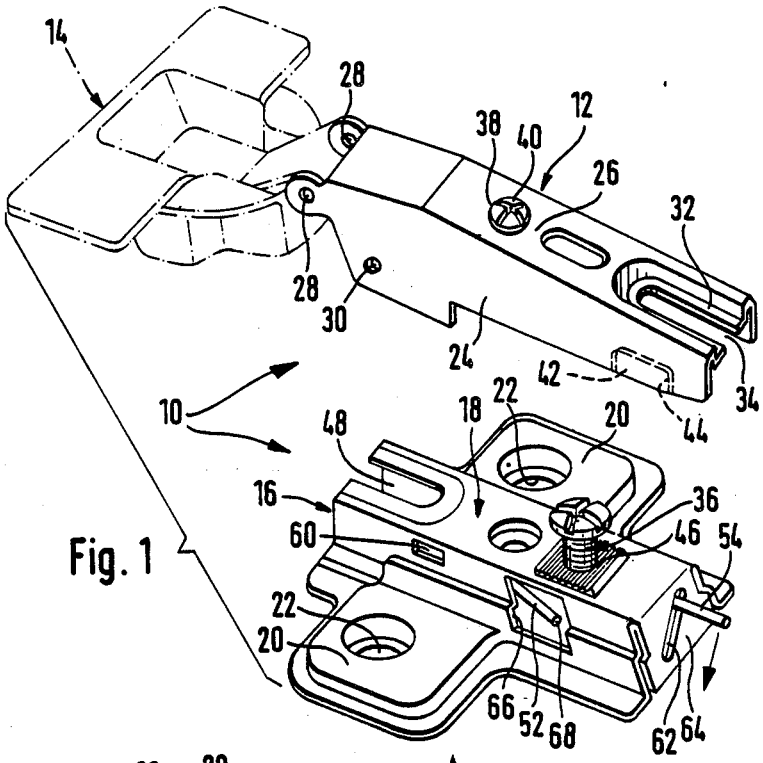
FIG. 1 is a perspective view of a first embodiment of the cabinet hinge of the invention with the arm of the hinge represented as lifted away from the mounting plate.

FIG. 1 shows a cabinet hinge, designated as a whole by the number 10, which is in the form of a so-called four-pivot hinge, whose jamb-related part is the arm 12, which is coupled by a four-pivot mechanism formed by two links—not shown in detail—to a door-related part in the form of a cup 14 which can be set flush in a mortise in the back of a door. The cup 14 is indicated by broken lines in FIG. 1 since the improvements made according to the invention have no connection with it.

The hinge arm 12 in turn can be fastened adjustably on a mounting plate 16, which can be made of sheet metal by a stamping and pressing method. From opposite sides of an elevated bridge 18 on the mounting plate extend low, wing-like projections 20, each provided with a mounting bore 22. Mounting plates having such lateral mounting wings are also called "wing plates." It is not essential to the invention, however, whether the mounting plate is configured as a wing plate in the manner represented or is of the otherwise commonly used oblong configuration.

The arm 12, which is also made from sheet metal by the stamping and pressing method, has a substantially channel-shaped cross section, whose side walls or flanges 24 are joined together along their upper margins by a web 26. In the end portion located on the left in FIG. 1, two bores 28 and 30 are provided in the flanges 24, which serve for the accommodation of pivot pins on which the eyes of the hinge links forming the four-pivot mechanism are journaled.

On the right in FIG. 1, i.e., in the substantially flat depressed end portion 32 between the flanges 24 there is provided an open-ended slot 34 which serves to receive the threaded shaft of a screw 36 with which the arm 12 is fastened at its cabinet-interior end on the mounting plate 16. The depressed end portion 32 is best provided on its underside with transverse serrations, not shown.

At a distance from the depressed end portion 32 there is provided in the center of the web 26 a tap 38 into which a threaded spindle 40 is threaded, on whose interior end between the flanges 24 there is provided a holding head of enlarged diameter (not shown) connected to the threaded spindle by a narrow stem. Thus, an annular constriction is created between the shaft of the threaded spindle 40 and the holding head. Oblong recesses 42 are formed opposite one another in the inner surfaces of the flanges 42 toward the cabinet-interior end of the arm, and each recess has a vertical abutment 44 at its interior end, i.e., the right end in FIG. 1.

The bridge 18 of the mounting plate 16, which is raised above the wing-like projections 20, has in its upper portion a width corresponding approximately to the clear width between the inner faces of the flanges 24 of the arm 12, so that the arm 12 can be slipped onto the mounting plate 16 such that the flanges 14 straddle the bridge 18. In the end area of the mounting plate 16 remote from the hinge links, i.e., on the right in FIG. 1, there is provided a fixing area 46 which has transverse serrations matching the above-mentioned transverse serrations in the end portion of the arm 12. Approximately in the middle of the fixing area 46 there is provided a tap to accommodate the shaft of the screw 36. At its front end, the bridge 18 is provided with a slot 48 open at the hinge link end, whose width is such that the stem between the holding head and the actual threaded portion of the above-mentioned threaded spindle 40 can be fitted into it. The arm 12 is mounted on the mounting plate 16 by pushing it with its slot 34 under the head of the previously loosened screw 36 and at the same time inserting the stem joining the holding head to the threaded shaft of the threaded spindle 40 into the slot 48. It is clear that the arm 12 can be fastened at selectable positions on the mounting plate 16 within the length of the slot 34 and slot 48, the arm being then secured against longitudinal displacement by tightening the screw 36 which clamps the transverse serrations on the underside of the end portion 32 against the transverse serrations in the fixing area 46. It is furthermore apparent that the distance between the front end, i.e., the hinge-joint end, of the arm 12 and the mounting plate surface formed by the base of the wing projections 20 and contacting an associated jamb can be varied by varying the depth to which the threaded spindle 40 is driven into the tap 38. The arm 12 is therefore adjustable in two coordinate directions, namely longitudinally and at right angles thereto, i.e., approximately perpendicularly to the surface of the jamb wall.

Figure 2:
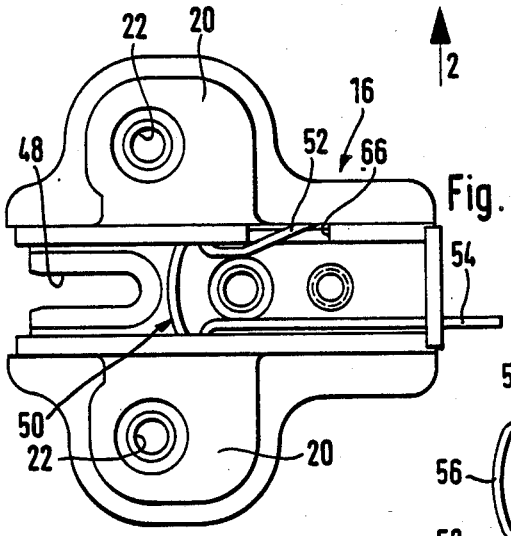
FIG. 2 is a bottom view of the mounting plate, seen in the direction of the arrow 2 in FIG. 1.
Figure 3:
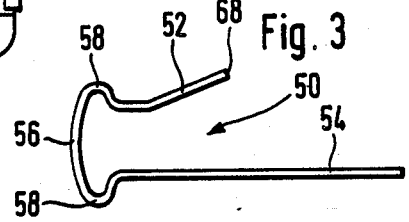
FIG. 3 is a plan view of the spring wire catch element used in the hinge according to FIGS. 1 and 2.

As it can be seen from FIG. 2, showing the mounting plate 16 from its underside, a catch element 50, in the form of a steel hairpin spring, also represented separately in FIG. 3, is disposed in the cavity formed in mounting plate 16 by the bridge 18. The legs 52 and 54 of the spring are of unequal length and are joined together integrally by an arcuate section 56, the transitions between the arcuate section 56 and the legs 52 and 54 being bent sharply in the manner seen at 58 in FIG. 3, so that they can snap into associated openings 60 (FIG. 1) in the side walls of the bridge 18 of the mounting plate 16. The longer leg 54 also passes through a slanting slot 62 (FIG. 1) in the end wall 64 at the cabinet-interior end of the bridge, its protruding end forming a handle which can be displaced in the direction of the slanting slot 62. Normally the leg is situated at the upper right end of the slot as seen in FIG. 1, and can be shifted downward and to the left. The catch element 50 is thus rocked downwardly as a whole, the rocking axis being formed by the sharply bent transitions 58 held in the openings 60. In this rocking movement, the shorter leg 52 is also swung downwardly. This leg 52, which reaches outwardly at an angle into an opening 66 in a side wall of the bridge 18 of the mounting plate, and whose free end, pointing backward, protrudes slightly from the side wall, forms with its rearwardly pointing extremity an abutment 68 which, when the arm 12 is pushed onto the mounting plate 16, cooperates with the catch abutment 44 such that, as the arm is pushed on, the end section of the leg 52 is initially forced back into the opening 66 by the side wall 24, until the catch abutment 44 of the recess 42 has been pushed past the catch 68. Then the end section of leg 52 snaps into the recess 42 and the arm 12 is secured against withdrawal from the mounting plate. The position of the abutments 44 on the inside surfaces of the flanges 24 of the arm 12 on the one hand and of the abutment 68 of the catch element 50 on the other is selected such that, when the arm is pushed onto the mounting plate, they come into catching engagement just as the shaft of the screw 36 enters the mouth of the slot 34 and the stem on the threaded spindle 40 enters the mouth of the slot 48.

It is clear that the catching engagement can be released without further backing out of the screw 36, by pressing the protruding end of leg 54 in slot 62 diagonally downward; the rocking movement is thus transmitted to the leg 52 and the abutment 68 formed on the latter is turned downwardly out of engagement with the abutment 42. The leg 54, which is normally already under bias at the upper end of the slot 62 is additionally flexed downward upon the downward pressure on account of the slant of the slot. The leg 54 therefore strives to snap back after release, and it will be guided back along the lower slanting edge of slot 62, upwardly at an angle, to the starting position.

In FIGS. 4 to 7 there is shown a cabinet hinge 10′ that is a modification of the one described above, and differs from hinge 10 only with regard to the configuration and arrangement of the catch element in the mounting plate 16. Therefore only these modifications will be described, while otherwise it is sufficient to refer to the above description, inasmuch as equivalent parts of hinges 10 and 10′ are given the same reference numbers in the drawing.

The catch element 70 is in the form of the leaf spring shown in FIGS. 6 and 7, and has at its end on the left in the drawing the chamfered end tabs 72 projecting outwardly from the two longitudinal edges; the tabs 72 are snapped into mating slots 74 in the side walls of the bridge 18 of the mounting plate and hold the leaf springs tightly at this end within the bridge 18. The leaf spring is divided by a central slot 76 extending over part of its length into two parallel tongues 78*a* and 78*b*, the slot 76 being provided mainly for the purpose of permitting the insertion of the free end of the shaft of the screw 36 and of any other screws driven through the center of the bridge 18. Furthermore, the lateral elasticity of these tongues, which is created by the division of the leaf spring, also enables the tabs 72 to snap into the slots 74. In the rearward end area the two tongues 78*a* and 78*b* unite to form an integral section 78 of the leaf spring, which narrows to the end section 80 which passes through an opening 82 in the rear end wall 64 of the bridge and forms the handle of the catch element 70.

In the area of the cutouts 66 provided in this case in the confronting side walls of the bridge 18, the catch element 70 has two tab-like projections 84 which are chamfered at their edges and which pass each through its corresponding cutout 66 into the path of the flanges 24 of the arm 12 as the arm is installed on the bridge 18. By the configuration shown especially in FIG. 7, in which the projections 84 are disposed in an upwardly slanting section of the leaf spring tongues 78*a* and 78*b*, the projections 84 also slant upwardly, so that their upper part forms a ramp for the leading end of the arm 12 as it is being installed on the mounting plate, which forces the projections downwardly within the cutouts 66 until the recess 42 passes over the projections, whereupon the latter snap into the recess 42. The edges 86 of the tab-like projections 84 then form with the locking edges 44 of the arm recess 42 effective locking edges of the catch element 70 for securing the arm 12 against withdrawal from the mounting plate 16.

It is easily seen that the engagement of the locking edges 44 and 86, which secures the arm on the mounting plate against accidental withdrawal, can be deliberately released by pressing down the end section of the catch element 70 in the opening 82, thus bringing the tab-like projections 84 below the bottom edges of the flanges 24 of the arm 12.

The fastening of the catch element within the bridge section 18 of the mounting plate 16 can, of course, be performed in some other manner, e.g., by riveting its hinge-link end to the bridge 18. It is furthermore to be noted that the snap locking according to the invention is not limited to the "wing plates" especially described, but can be applied generally in cases in which a hinge arm at least partially straddling the mounting plate is pushed longitudinally onto this mounting plate during assembly. Instead of the mounting plate 16 produced from sheet metal by the stamping and pressing method, the mounting plate, as well as the hinge arm, can also be made of metal, e.g., from zinc alloy (Zamak) by pressure casting.

We claim:

1. A cabinet hinge with a jamb-related part in the form of an elongated supporting arm of substantially U-shaped cross section which is coupled pivotingly by a hinge link to a door-related part and which is mounted releasably and, in at least two coordinate directions, adjustably on a mounting plate having a base surface fastenable to a jamb of a cabinet carcase, the supporting arm having side walls formed by legs of the U and at least partially straddling the mounting plate, the supporting arm having an end wall joining the side walls and having a longitudinal slot at an end remote from the door-related part, said slot having an enlarged pass-through or open-ended opening, a shaft of a fastening screw driven into the mounting plate and passing through the slot, at a distance from the longitudinal slot there being a tap through which passes a threaded spindle thrusting against the mounting plate, in at least one of the side walls of the supporting arm there being a recess or opening having a locking edge disposed substantially at right angles to the base surface of the mounting plate and pointing toward the door-related part, in the mounting plate opposite the recess or opening a resilient catch element protruding from a side surface of the mounting plate and having a locking edge pointing away from the door-related part and disposed in such a position that the locking edge on the supporting arm and the locking edge of the catch element come into catching engagement upon a longitudinal displacement of the supporting arm on the mounting plate parallel to the base surface as soon as the shaft of the fastening screw driven into the mounting plate enters the pass-through or open-ended opening of the-longitudinal slot, the resilient catch element having an extension protruding through a further opening in the end of the mounting plate remote from the door-related part, said extension being resiliently displaceable in the further opening such that the locking edges come out of engagement.

2. A cabinet hinge according to claim 1, wherein the catch element is formed by an end section of one of two legs of a hairpin spring of spring-elastic wire, said spring being mounted within the mounting plate such that the free end of said one leg protrudes through a cutout in said one side wall of the mounting plate away from the door-related part and slantingly into the supporting arm, said hairpin spring having a section joining the two legs, said joining section being mounted pivotingly in the mounting plate about an axis running substantially parallel to the base surface of the mounting plate and at right angles to its length, the other leg of the hairpin spring extending through the further opening in the mounting plate.

3. A cabinet hinge according to claim 2, wherein the further opening is a slanting slot.

4. A cabinet hinge according to claim 1, the resilient catch element is a leaf spring having a first end adjacent the door-related part and held tightly clamped within the mounting plate and a second end remote from the door-related part and forming the extension protruding through the further opening of the mounting plate, the leaf spring having at least at one of its opposite longitudinal margins a tab-like projection projecting laterally through a cutout in a side wall of the mounting plate and into the path of the supporting arm and slanting upwardly from a lower transverse edge away from the door-related part.

5. A cabinet hinge according to claim 4, wherein the leaf spring is fastened to the mounting plate at its end adjacent the door-related part.

6. A cabinet hinge according to claim 4, wherein the leaf spring is divided within the mounting plate by a slot extending over a portion of the length of the spring into two laterally spaced parallel tongues between which the shaft of fastening screw driven into the mounting plate may pass.

7. A cabinet hinge according to claim 6, wherein the slot is open at the end of the leaf spring adjacent the door-related part, the tongues-having at end portions adjacent the door-related part at outer longitudinal margins adjacent the mounting plate side walls a chambered tab engaging a mating opening or recess in the side walls.

* * * * *